US007607381B2

(12) United States Patent
Kauss et al.

(10) Patent No.: US 7,607,381 B2
(45) Date of Patent: Oct. 27, 2009

(54) CONTROL DEVICE FOR A WORK DEVICE COMPRISING A SCOOP HELD ON AN EXTENSION ARM

(75) Inventors: Wolfgang Kauss, Francheville (FR); Frederic Lamarche, Chazay d'Azergues (FR)

(73) Assignee: Bosch Rexroth AG, Stuttgart (DE)

( * ) Notice: Subject to any disclaimer, the term of this patent is extended or adjusted under 35 U.S.C. 154(b) by 36 days.

(21) Appl. No.: 10/538,697

(22) PCT Filed: Dec. 8, 2003

(86) PCT No.: PCT/EP03/13898

§ 371 (c)(1),
(2), (4) Date: Nov. 3, 2006

(87) PCT Pub. No.: WO2004/055274

PCT Pub. Date: Jul. 1, 2004

(65) Prior Publication Data

US 2007/0169620 A1 Jul. 26, 2007

(30) Foreign Application Priority Data

Dec. 18, 2002 (DE) ..... 102 59 120
Jul. 28, 2003 (DE) ..... 103 34 321

(51) Int. Cl.
*E02F 3/43* (2006.01)
*F15B 11/20* (2006.01)

(52) U.S. Cl. ..... 91/532; 91/515

(58) Field of Classification Search ..... 91/513, 91/515, 532
See application file for complete search history.

(56) References Cited

U.S. PATENT DOCUMENTS 3,179,120 A * 4/1965 Erickson et. al. ..... 91/516
4,683,802 A * 8/1987 Prokop et al. ..... 91/516
4,709,618 A * 12/1987 Zongker ..... 91/516
5,442,868 A * 8/1995 Ahn
5,447,094 A * 9/1995 Geyler, Jr. ..... 91/520
5,797,310 A * 8/1998 Casey et al. ..... 91/515

(Continued)

FOREIGN PATENT DOCUMENTS

JP 2001090703 * 4/2001

OTHER PUBLICATIONS

Patent Abstracts of Japan, vol. 2000 No. 21, Aug. 3 2001.*

*Primary Examiner*—Thomas E Lazo
(74) *Attorney, Agent, or Firm*—Lucas & Mercanti, LLP; Klaus P. Stoffel

(57) ABSTRACT

On a work appliance, an extension arm is held rotatably, and a scoop is held rotatably on the extension arm. Actuation of the extension arm and of the scoop is by means of hydraulic cylinders. Each cylinder is assigned a valve which controls the flow of pressure medium from a pump to the cylinder and from the latter to the tank. A rotational movement of the extension arm is accomplished with the top edge of the scoop maintaining its angular position when the extension arm is being raised or lowered. Valves which control the flow of pressure medium to the cylinders are activated with the ratio of the pressure medium quantities supplied to the cylinders being kept at a constant value independently of the size of the control signal controlling the flow of pressure medium to a cylinder for the actuation of the extension arm.

12 Claims, 6 Drawing Sheets

U.S. PATENT DOCUMENTS 6,209,322 B1 * 4/2001 Yoshida et al.
6,308,612 B1 * 10/2001 Emanie et al. ..... 91/515
6,389,953 B1 * 5/2002 Altman et al. ..... 91/515
6,561,751 B1 * 5/2003 Ishizaki et al. ..... 91/520

* cited by examiner

CONTROL DEVICE FOR A WORK DEVICE COMPRISING A SCOOP HELD ON AN EXTENSION ARM

The invention relates to a control device for a work appliance comprising a scoop held on an extension arm, as set forth in the claims.

In a work appliance of this type, for example a wheeled loader, the extension arm is held rotatably on the frame of the work appliance. The actuation of the extension arm takes place by means of a first hydraulic cylinder which engages on the frame of the work appliance and on the extension arm. The rotary angle of the extension arm is limited by the stroke of the first cylinder. The scoop is held rotatably on the extension arm. For actuating the scoop, a second hydraulic cylinder is provided, which engages on the extension arm and on the scoop. The rotary angle of the scoop is limited by the stroke of the second cylinder. In the case of double-acting cylinders, the actuation of the cylinders takes place by means of the supply of pressure medium to one chamber of a cylinder and the simultaneous discharge of pressure medium from the other chamber of the cylinder in each case. In order to raise the scoop of a work appliance of this type, the extension arm is rotated about its articulation point on the frame of the work appliance. If, in this case, there is no supply of pressure medium to the cylinder intended for the rotational movement of the scoop, the scoop maintains its angle with respect to the extension arm, that is to say, as in the case of a rigid connection between the extension arm and the scoop, the scoop is driven according to the rotational movement of the extension arm. The result of this is that the scoop is tilted relative to its original angular position with respect to the ground. There is in this case the risk of material falling out of the tilted scoop. Material falling out of the scoop may put the operator at risk, particularly when the cab of the work appliance is located in this region. Also in order to rule out such a risk, it is required that the scoop, when being raised, maintains its angular position in relation to the ground independently of the rotational movement of the extension arm.

In order to satisfy this requirement, various measures have already been taken. Thus, for example, by means of a special configuration of the kinematics of the extension arm and of the scoop, a mechanical parallel guidance of the scoop during the raising of the extension arm was implemented, instead of rotary joints for the extension arm and the scoop. In another solution, the position angle of the scoop in relation to a reference plane, for example in relation to the horizontal, is regulated. For this purpose, the position angle of the scoop is measured by an electrical position sensor and is compared with a desired position value. In the event of a deviation of the output signal of the position sensor from the desired position value, the cylinder intended for the rotational movement of the scoop is acted upon by a pressure medium, during the raising of the extension arm, in such a way that the scoop resumes its original position with respect to the horizontal. This ensures that the scoop maintains its angular position during raising. A further possibility for ensuring that the scoop maintains its angular position during raising is to provide, in addition to the valves which control the pressure medium quantity supplied to the cylinders, a control block which supplies a predetermined part of the pressure medium, which is displaced out of the cylinder for the actuation of the extension arm during the raising of the latter, to the cylinder for the rotational movement of the scoop. The use of a control block of this type incurs appreciable costs. Moreover, a control block of this type takes up additional space and requires pipework for its connections to the cylinders and to the valves for actuating the extension arm and the scoop.

SUMMARY OF THE INVENTION

The object on which the invention is based is to provide a cost-effective control device of the type initially mentioned.

This object is achieved by means of the features set forth in the claims. For the implementation of the invention, subassemblies may be adopted which are normally used in control blocks for load-independent throughflow distribution which are formed in a disk type of construction.

Advantageous developments of the invention are characterized in the subclaims. They relate to particulars of a control device according to the invention with pressure-controlled valves for the supply of pressure medium to the cylinders.

BRIEF DESCRIPTION OF THE DRAWINGS

The invention is explained in more detail below, together with its further particulars, by means of exemplary embodiments illustrated in the drawings in which.

DETAILED DESCRIPTION OF THE PREFERRED EMBODIMENT(S)

Figure 1:
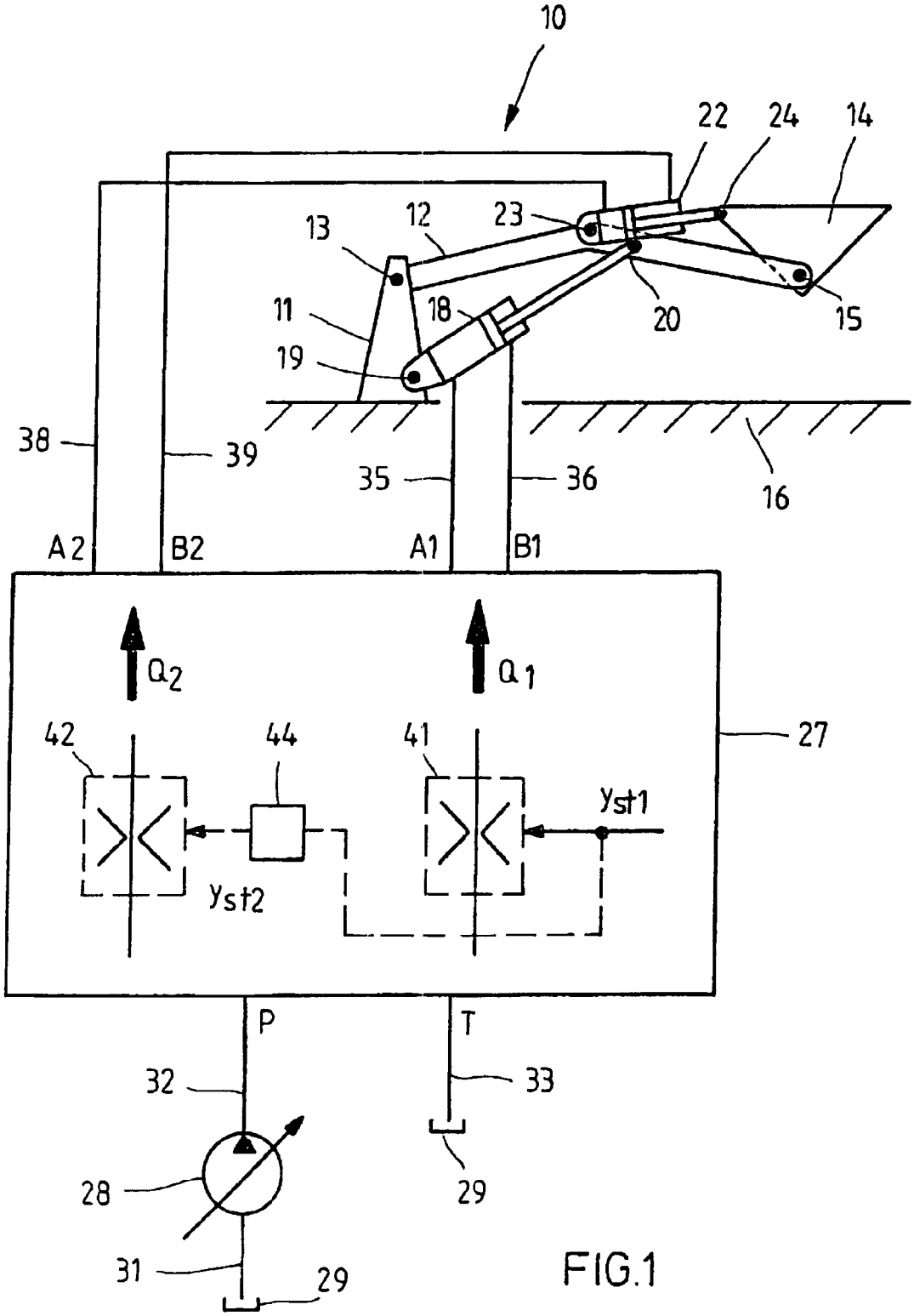
FIG. 1 shows a diagrammatic illustration of a work machine with a scoop held on an extension arm and of a control device according to the invention for a work machine of this type.

FIG. 1 shows a diagrammatic illustration of a work machine 10, on the frame 11 of which is held an extension arm 12 which is rotatable about an articulation point 13. Held on the extension arm 12 is a scoop 14 which is rotatable with respect to the extension arm 12 about an articulation point 15. The ground on which the work machine 10 stands is given the reference symbol 16. A first double-acting hydraulic cylinder 18 is arranged between the frame 11 and the extension arm 12. The corresponding articulation points are given the reference symbols 19 and 20. The rotary angle of the extension arm 12 is limited by the stroke of the cylinder 18. A second double-acting hydraulic cylinder 22 is arranged between the extension arm 12 and the scoop 14. The corresponding articulation points are given the reference symbols 23 and 24. The rotary angle of the scoop 14 is limited by the stroke of the cylinder 22. A control device 27 with six connections P, T, A1, B1, A2, B2 for hydraulic pressure medium controls the flow of pressure medium from a pump 28 to the cylinders 18 and 22 and from the cylinders 18 and 22 back to a tank 29. The pump 28 is advantageously constructed as a variable displacement pump. It is connected to the tank 29 via a first hydraulic line 31 and to the connection P of the control device 27 via a further line 32. The tank 29 is connected to the connection T of the control device 27 via a further hydraulic line 33. The two chambers of the cylinder 18 are connected to the connections A1 and B1 of the control device 27 via lines 35 and 36. The chambers of the cylinder 22 are connected in the same way to the connections A2 and B2 of the control device 27 via lines 38 and 39. Two hydraulic valves 41 and 42, illustrated diagrammatically, control the pressure medium quantities supplied to the cylinders 18 and 22. A control signal $y_{st1}$ supplied to the valve 41 determines the pressure medium quantity which is supplied to the cylinder 18 and which is designated below by $Q_1$. A control signal $y_{st2}$ supplied to the valve 42 determines in the same way the pressure medium quantity which is supplied to the cylinder 22 and which is designated below by $Q_2$. The control signal $y_{st1}$ supplied to the valve 41 is additionally supplied to a block 44. The output signal of the latter is supplied as a control signal $y_{st2}$ to the valve 42. The transmission behavior of the block 44 is in this case selected such that the ratio $Q_2/Q_1$ of the pressure medium quantities $Q_2$ and $Q_1$ supplied to the cylinders 22 and 18 is held at a constant value, which is designated below by $K_Q$, independently of the size of the control signal $y_{st1}$, the construction of the valves 41 and 42 being taken into account. The relation $Q_2=K_Q \times Q_1$ thus applies to the pressure medium quantity $Q_2$ supplied to the cylinder 22.

To raise the scoop 14, the control device 27 supplies pressure medium to the cylinder 18 via the line 35. The supply of pressure medium quantity $Q_1$ is determined by the control signal $y_{st1}$ supplied to the valve 41. The piston of the cylinder 18 moves out according to the supplied pressure medium quantity $Q_1$ and rotates the extension arm 12 counterclockwise. Without a simultaneous supply of pressure medium to the cylinder 22, the top edge of the scoop 14 would rotate counterclockwise with respect to the ground 16. So that the scoop top edge maintains its original angular position in relation to the ground 16, the control device 27 supplies the cylinder 22, simultaneously with the supply of pressure medium to the cylinder 18, with a pressure medium quantity $Q_2$, determined by the control signal $y_{st2}$, via the line 38. The piston of the cylinder 22 thereby moves out, and the scoop 14 rotates clockwise. The pressure medium quantity $Q_2$ supplied to the cylinder 22 is in this case coordinated with the pressure medium quantity $Q_1$ supplied to the cylinder 18 in such a way that the rotational movement of the scoop 14 taking place clockwise exactly compensates the rotational movement of the scoop 14 caused as a result of the raising of the extension arm 12 and taking place counterclockwise. For this purpose, the valve 42 is activated in such a way that the pressure medium quantity $Q_2$ is in a fixed ratio to the pressure medium quantity $Q_1$ supplied to the cylinder 18 for the actuation of the extension arm 12, independently of the size of the control signal $y_{st}$ which is supplied to the valve 41 and which determines the pressure medium quantity $Q_1$. The control device 27 thus activates the valve 42 in such a way that the relation $Q_2=K_Q \times Q_1$ is fulfilled for the pressure medium quantities $Q_1$ and $Q_2$ independently of the size of the control signal $y_{st1}$. The factor $K_Q$ is a constant value which is determined by the construction of the work machine 10 and by the dimensioning of the cylinders 18 and 22. The value of $K_Q$ indicates the ratio in which the pressure medium quantity $Q_2$ supplied to the cylinder 22 must be to the pressure medium quantity $Q_1$ supplied to the cylinder 18, so that, during the raising or lowering of the extension arm 12, the scoop 14 essentially maintains its angular position with respect to the ground 16. The size of the factor $K_Q$ can be determined by means of calculations which include the structural configuration of the work machine 10 and the dimensioning of the cylinders 18 and 22. Another possibility for determining the size of the factor $K_Q$ is to provide a position controller temporarily for the scoop 14 in the trial phase of the work machine 10, said position controller keeping the angular position of the top edge of the blade 14 with respect to the ground 16 constant, particularly during the raising and lowering of the extension arm 12. In this time, the connection between the control signals $y_{st1}$ and $y_{st2}$ via the block 44 is interrupted. Instead, the manipulated variable of the position controller, not illustrated in FIG. 1, is supplied as the control variable $y_{st2}$ to the valve 42. The pressure medium quantities $Q_1$ and $Q_2$ supplied to the cylinders 18 and 22 are recorded as a function of the control signal $y_{st1}$. The factor $K_Q$ arises from a comparison of the pressure medium quantity $Q_2$ supplied to the cylinder 22 with the pressure medium quantity $Q_1$ which is supplied to the cylinder 18 and which is predetermined by the control signal $y_{st1}$. After the factor $K_Q$ has been determined in the way described, the position controller is no longer required. The position controller is removed, and the connection between the control signals $y_{st1}$ and $Y_{st2}$ via the block 44 is restored. Thereafter, the transmission behavior of the block 44 is set on the basis of the above-determined value of the factor $K_Q$ in such a way that the relation $Q_2=K_Q \times Q_1$ is fulfilled.

Figure 2:
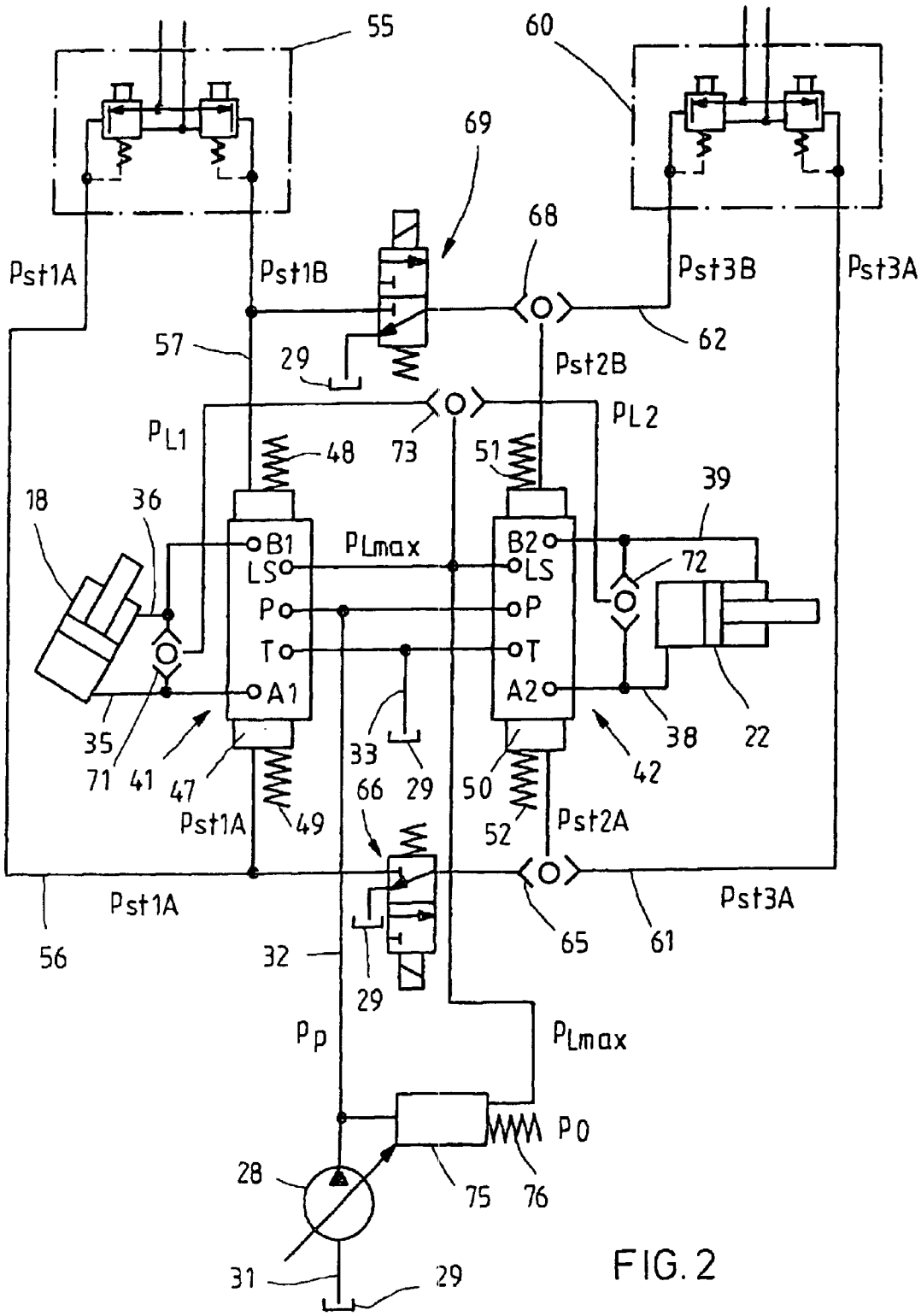
FIG. 2 shows a first embodiment of the control device illustrated in FIG. 1.

FIG. 2 shows a more detailed illustration of the control device 27, initially illustrated in general form in FIG. 1. For reasons of space, FIG. 2 illustrates only the cylinders 18 and 22, but no structural particulars of the work machine 10, such as the frame 11, the extension arm 12 or the scoop 14. In this exemplary embodiment, the valves 41 and 42 are constructed as pressure-controlled directional valves. Control pressures designated by $p_{st1A}$ and $p_{st1B}$ serve as control signals for the valve 41. Control pressures designated by $p_{st2A}$ and $p_{st2B}$ serve as control signals for the valve 42.

The valve 41 has a slide 47 which is tension-mounted between two springs 48 and 49. The slide 47 is acted upon in one direction by the control pressure $p_{st1A}$ counter the force of the spring 48. The slide 47 is acted upon in the opposite direction by the control pressure $p_{st1B}$ counter to the force of the spring 49. The springs 48 and 49 hold the slide 47 in a defined position of rest when it is not acted upon by a control pressure either from one side or from the other side. When the slide 47 is acted upon by the control pressure $p_{st1A}$, it compresses the spring 48 until the product of the control pressure $p_{st1A}$ and of that area of the slide 47 which is acted upon by it is equal to the force of the spring 48. The resulting position of the slide 47 is a measure of the control pressure which acts upon the slide 47. The slide 47 is provided with a first notch controlling the flow of pressure medium to the cylinder 18. Such a notch is described in more detail further below with reference to FIG. 5 in connection with an embodiment of the valve 42. The notch runs in the longitudinal direction of the slide 47 and, together with a control edge, determines the size of the passage cross section $A_{A1}$ of the valve 41 in the event of a flow of pressure medium from the connection A1 of the valve 47 via the line 35 into the bottom-side chamber of the cylinder 18. The notch is formed in such a way that there is a linear relation between the position of the slide 47 with respect to the control edge and the passage cross section $A_{A1}$. There is therefore also a linear relation between the control pressure $p_{st1A}$ and the passage cross section $A_{A1}$. In this exemplary embodiment, the assignment between the control pressure $p_{st1A}$ and the pressure medium quantity $Q_1$ supplied to the cylinder 18 is selected such that, when the control pressure $p_{st1A}$ acts upon the slide 47, the pressure medium flows, as described above, from the connection, designated by A1, of the valve 41 into the bottom-side chamber of the cylinder 18. As already described with reference to FIG. 1, such a flow of pressure medium leads to a raising of the extension arm 12.

When the control pressure $p_{st1B}$ is supplied to the slide 47 from the opposite side, the latter compresses the spring 49 until the product of the control pressure $p_{st1B}$ and of that area of the slide 47 which is acted upon by it is equal to the force of the spring 49. The slide 47 is provided with a further notch likewise running in the longitudinal direction of the slide 47. This notch, together with a further control edge, determines the size of the passage cross section $A_{B1}$ of the valve 41 for a flow of pressure medium from the connection B1 of the slide 41 via the line 36 to the rod-side chamber of the cylinder 18. This notch, too, is formed in such a way that there is a linear relation between the position of the slide 47 with respect to the control edge and the passage cross section $A_{B1}$. There is therefore also a linear relation between the control pressure $p_{st1B}$ and the passage cross section $A_{B1}$. When the control pressure $p_{st1B}$ acts upon the slide 47, the pressure medium flows from the connection designated by B1 into the rod-side chamber of the cylinder 18. This flow of pressure medium moves in the piston of the cylinder 18 and consequently lowers the extension arm 12.

The valve 42 is constructed in the same way as the valve 41. A slide 50 is held between two springs 51 and 52. The control pressures supplied to the valve 42 are designated by $p_{st2A}$ and $p_{st2B}$. The slide 50 is provided on both sides with notches which, in cooperation with a control edge of the valve 42, determine the size of the passage cross sections, designated by $A_{A2}$ and $A_{B2}$, as a function of the deflection of the slide 50. In this case, there is a linear relation both between the passage cross section $A_{A2}$ and the control pressure $p_{at2A}$ supplied to the slide 50 from one side and between the passage cross section designated by $A_{B2}$ and the control pressure $p_{st2B}$ supplied to the slide 50 from the opposite side. When the slide 50 is acted upon by the control pressure $p_{st2A}$, the slide 50 is pressed counter to the spring 51, and pressure medium flows from the connection A2 via the line 38 into the bottom-side chamber of the cylinder 22. As already described with reference to FIG. 1, such a stream of pressure medium leads to a clockwise rotation of the scoop 14. When the slide 50 is acted upon by the control pressure $p_{st2B}$, the slide 50 is pressed counter to the spring 52, and pressure medium flows from the connection B2 via the line 39 into the rod-side chamber of the cylinder 22. This stream of pressure medium leads to a counterclockwise rotation of the scoop 14.

Subassemblies of control blocks formed in the disk type of construction may be used for implementing the invention. In the case of such subassemblies, the diameters of the bores for the slides of the valves are generally equal. Those areas of the slides which are acted upon by the control pressure are therefore also equal. Variables available for the passage cross section of the valves which is dependent on the control pressure are therefore still the spring constant and the configuration of the notches cooperating with a control edge. If the spring constants of the springs are also equal, the variable still remaining for the passage cross section of the valves which is dependent on the control pressure is the configuration of the notches.

A first pilot control apparatus 55, which is preferably designed as a joystick, delivers the control pressures $p_{st1A}$ and $p_{st1B}$ for the valve 41. The control pressures $p_{st1A}$ and $p_{st1B}$ are set according to the deflection of the joystick. The control pressure $p_{st1A}$ is supplied to the slide 47 via a line 56. The control pressure $p_{st1B}$ is supplied in the same way to the slide 47 via a further line 57. A further pilot control apparatus 60, which is preferably likewise constructed as a joystick, delivers control pressures designated by $p_{st3A}$ and $p_{st3B}$. The control pressures $p_{st3A}$ and $p_{st3B}$ are set according to the deflection of the joystick of the pilot control apparatus 60. Lines 61 and 62 lead from the pilot control apparatus 60 to the slide 50 of the valve 42. The inlet of the valve 42 for the control pressure $p_{st2A}$ is preceded by a shuttle valve 65. Between the line 56 and one inlet of the shuttle valve 65 is arranged a switching valve 66 which, in its working position, acts with the control pressure $p_{st1A}$ upon the one inlet of the shuttle valve 65. In its position of rest, illustrated in FIG. 2, the switching valve 66 interrupts the connection between the line 56 and the shuttle valve 65. The situation is considered below, however, where the switching valve 66 is in its working position. The control pressure $p_{st3A}$ is supplied to the other inlet of the shuttle valve 65 via the line 61. The shuttle valve 65 conducts, as control pressure $p_{st2A}$, the higher of the two control pressures supplied to it further on to the slide 50 of the valve 42. Correspondingly, the inlet of the valve 42 for the control pressure $p_{st2B}$ is preceded by a shuttle valve 68. Between the line 57 and one inlet of the shuttle valve 68 is arranged a further switching valve 69. The switching valve 69, in its working position, acts with the control pressure $p_{st1B}$ upon the one inlet of the shuttle valve 68. In the position of rest, illustrated in FIG. 2, the switching valve 69 interrupts the connection between the line 57 and the shuttle valve 68. Here, too, the situation is considered below where the switching valve 69 is in its working position. The control pressure $p_{st3B}$ is supplied to the other inlet of the shuttle valve 68 via the line 62. The shuttle valve 68 conducts, as control pressure $p_{st2B}$, the higher of the two control pressures supplied to it further on to the slide 50 of the valve 42.

A further shuttle valve 71 and 72 is arranged in each case between the lines 35 and 36 and between the lines 38 and 39. The shuttle valve 71 conducts the higher of the chamber pressures of the cylinder 18 further on to one inlet of a further shuttle valve 73. The shuttle valve 72 conducts the higher of the chamber pressures of the cylinder 22 further on to the other inlet of the shuttle valve 73. The shuttle valve 73 conducts, as command variable, the higher of the pressures supplied to it further on to a pump controller 75 and also to the connection, designated by LS, of the valves 41 and 42. This pressure is the highest load pressure, which is designated below by $p_{Lmax}$. The pump controller 75 sets the conveying volume of the pump 28 in such a way that the pump pressure, designated by $p_p$, is equal to the sum of the pressure $P_{Lmax}$ and of the pressure equivalent $p_0$ of a spring 76 acting on the pump controller 75 in the same direction as the pressure $P_{Lmax}$. In the case of what may be referred to as a supply shortfall, that is to say when the maximum conveying volume of the pump 28 is not sufficient to achieve the above-mentioned pressure equilibrium, the pressure $p_p$ assumes a value which is correspondingly lower than the sum of $P_{Lmax}$ and $P_0$.

To describe the functioning of the control device according to the invention, it is assumed that the scoop 14 lies on the ground 16 and the top edge of the scoop 14 is oriented parallel to the ground 16. In order to raise the scoop 14 out of this position, the joystick of the pilot control apparatus 55 is deflected out of its position of rest and the valve 41 is supplied with a control pressure $p_{st1A(50\%)}$ which corresponds, for example, to 50% of the maximum value, designated by $p_{st1Amax}$, of the control pressure $p_{st1A}$. As also explained in connection with FIG. 3, there corresponds to this control pressure a pressure medium stream $Q_{1(50\%)}$ which flows in the bottom-side chamber of the cylinder 18. This pressure medium stream rotates the extension arm 12 counterclockwise about the articulation point 13 and at the same time raises the scoop 14. Moreover, the control pressure $p_{st1A(50\%)}$ is supplied as control pressure $p_{st2A}$ to the valve 42 via the switching valve 66 and the shuttle valve 65. The control pressure $p_{st2A}=p_{st1A(50\%)}$ supplied to the valve 42 leads to a pressure medium stream $Q_2=K_Q \times Q_{1(50\%)}$ into the bottom-side chamber of the cylinder 22 which rotates the scoop 14 clockwise exactly to an extent such that, during raising, the top edge of the scoop 14 maintains its original position with respect to the ground 16. In these considerations, it was assumed that the control pressure $p_{st3A}$ is equal to zero, but at all events is lower than the control pressure $p_{st1A}$ If the scoop 14 is to be emptied during raising, the control pressure $p_{st3A}$ is increased in relation to the control pressure $p_{st1A}$ In this case, the scoop 14 rotates clockwise at the speed determined by the control pressure $p_{st3A}$. Since the scoop 14 then rotates clockwise at a speed which is higher than that for maintaining the position of its top edge, it is possible thereby to tip material out of the scoop 14.

Figure 3:
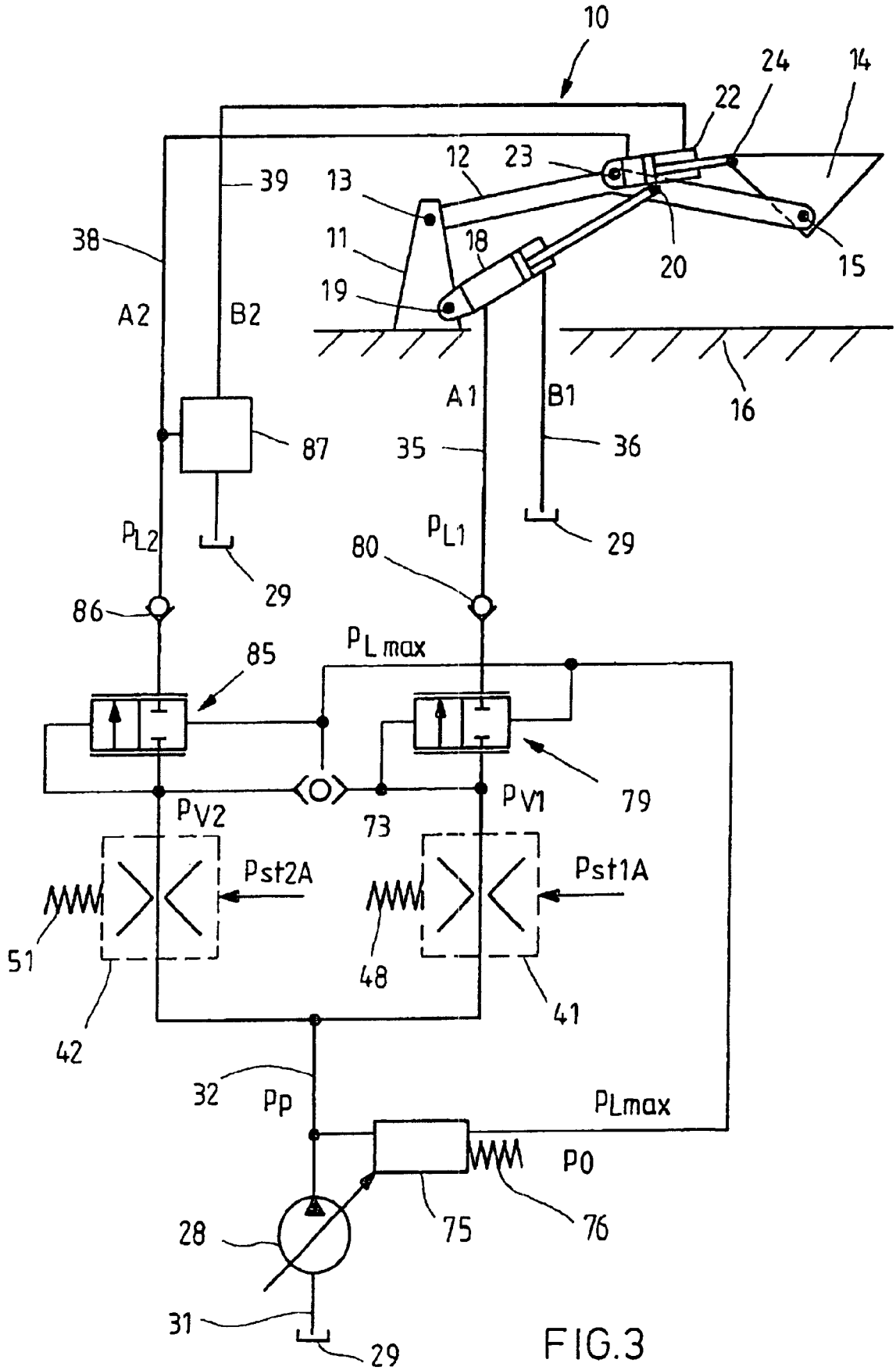
FIG. 3 shows particulars of the control device illustrated in FIGS. 1 and 2, insofar as they are required for a description of the upward movement of the extension arm.

On the basis of FIGS. 1 and 2, FIG. 3 shows further particulars of the control device, insofar as they are required for raising the scoop 14. The pressure medium stream $Q_1$ controlled by the valve 41 flows via a following pressure compensator 79, a load holding valve 80 and the line 35 into the bottom-side chamber of the cylinder 18. The return flow of the pressure medium out of the rod-side chamber of the cylinder 18 to the tank 29 takes place via the line 36. The pressure medium stream $Q_2$ controlled by the valve 42 flows via a following pressure compensator 85, a load holding valve 86 and the line 38 into the bottom-side chamber of the cylinder 22. The return flow of the pressure medium out of the rod-side chamber of the cylinder 22 to the tank 29 takes place via a counterholding valve 87, controlled by the pressure in the line 38, in the line 39. The counterholding valve 87 makes it possible to control the scoop 14, even under a pulling load, by means of the control of the inflow cross section of the valve 42. The pressure $p_{st1A}$ which is supplied as control pressure to the valve 41 is also supplied as control pressure to the valve 42. The control pressure $p_{st2A}$ is thus equal to the control pressure $p_{st1A}$. The pressure compensators 79 and 85 ensure that both the pressure, designated by $p_{V1}$, between the valve 41 and the pressure compensator 79 and the pressure, designated by $p_{V2}$, between the valve 42 and the pressure compensator 85 are kept equal to the highest load pressure $p_{Lmax}$. For this purpose, the pressure compensator assigned to the cylinder having the highest load pressure is open fully, and the other pressure compensator in each case is located in a regulating position, in which the pressure falling at it is equal to the difference between the highest load pressure and the load pressure of the cylinder assigned to it. The pressure drop $\Delta p_1=p_p-p_{V1}$ across the valve 41 is then equal to the pressure drop $\Delta p_2=p_p-p_{V2}$ across the valve 42. When the pump controller 75 is in its regulating range, the pressure drop $\Delta p_1$ across the valve 41 and also the pressure drop $\Delta p_2$ across the valve 42 are equal to the pressure equivalent $p_0$ of the spring 76. The pressure medium quantities $Q_1$ and $Q_2$ supplied to the cylinders 18 and 22 consequently correspond to the passage cross sections of the valves 41 and 42. If the ratio of the passage cross sections of the valves 41 and 42 is selected according to the factor $K_Q$ required for a parallel movement of the top edge of the scoop 14, the ratio of the pressure medium quantities $Q_1$ and $Q_2$ supplied to the cylinders 18 and 22 is independent of the size of the control pressure, with the control pressures being equal ($p_{st2A}=p_{st1A}$). This relation applies even in the event of the supply shortfall. In this case, although the individual pressure drops across the valves 41 and 42 are lower than $p_0$, nevertheless since the pressure drops remain equal to one another, there is no change in the ratio between the pressure medium quantities $Q_1$ and $Q_2$ supplied to the cylinders 18 and 22.

Figure 4:
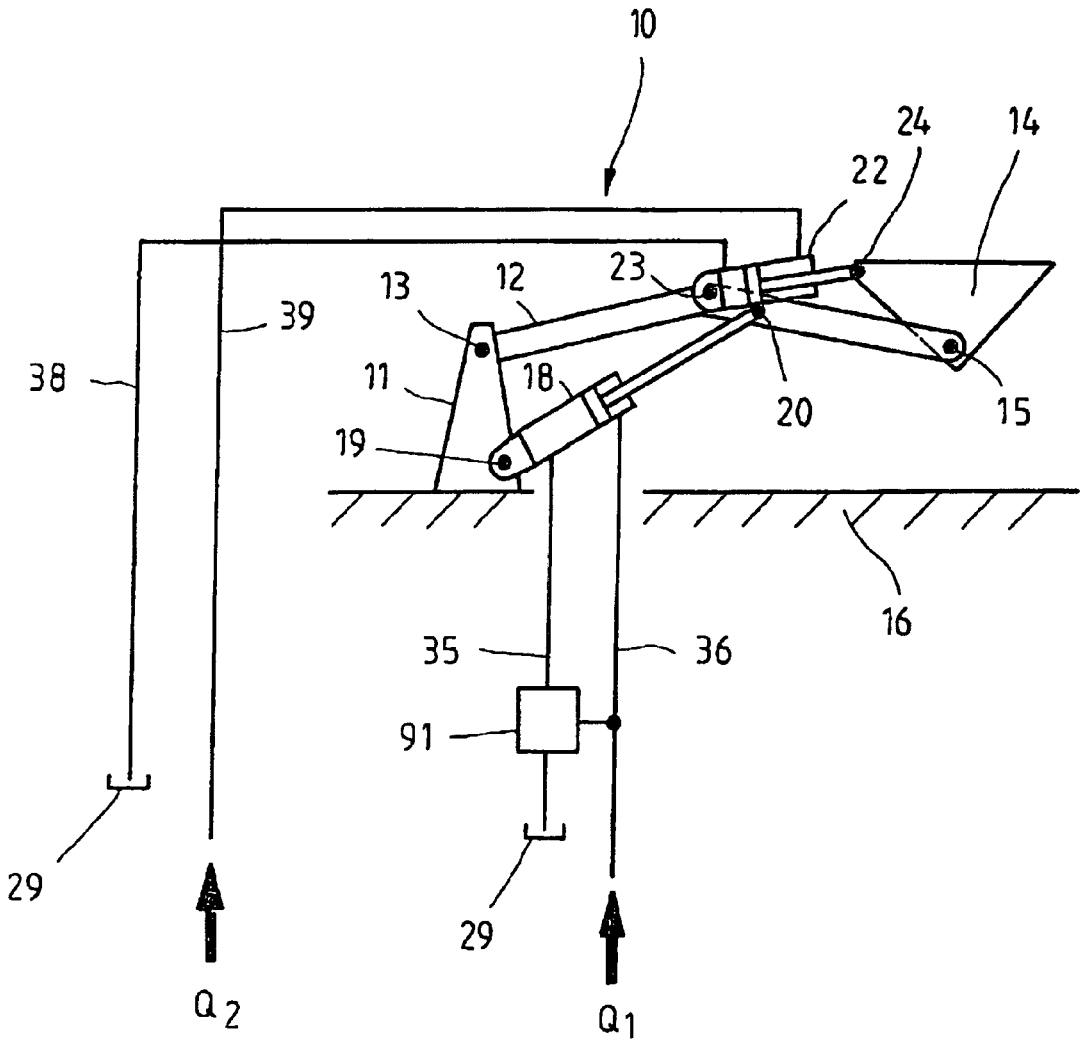
FIG. 4 shows particulars of the pressure medium flow during the downward movement of the extension arm.

FIG. 4 shows the pressure medium flow during the lowering of the extension arm 12, with a simultaneous rotational movement of the scoop 14 counterclockwise. In the line 35 leading from the bottom-side chamber of the cylinder 18 to the tank 29, a counterholding valve 91 is provided, which is controlled by the pressure in the line 36 leading to the rod-side chamber of the cylinder 18. It is consequently possible to control the extension arm 12, even under a pulling load, by means of the control of the inflow cross section of the valve 41.

FIG. 2 is again taken as the basis for the following explanation. According to an advantageous embodiment of the valves 41 and 42, it is possible, during the raising of the extension arm 12, to empty the scoop 14 only via the control pressure $p_{st1A}$. For this purpose, the valve 41 is provided, for the slide 47, with a stop, the position of which corresponds to the maximum value $Q_{1max}$ of the pressure medium quantity $Q_1$. The spring constant of the spring 48 is selected such that the slide 47 reaches the stop even at approximately 65% of the maximum value $p_{st1Amax}$ of the control pressure $p_{st1A}$ In this position of the slide 47, the maximum pressure medium quantity $Q_{1max}$ flows. The valve 42 is likewise provided with a stop for each slide 50. However, the spring constant of the spring 51 is selected such that the latter has covered only approximately 65% of its travel at the pressure at which the slide 47 already bears against its stop. In this range in which the control pressure $p_{st1A}$ has a value of between zero and $0.65\times p_{st1Amax}$, the relation between the pressure medium quantities $Q_2$ and $Q_1$ is ensured by means of a corresponding configuration of the notches determining the passage cross section of the valves 41 and 42. If the control pressure $p_{st1A}$ is then increased beyond the value of $0.65\times p_{st1Amax}$ to $p_{st1Amax}$, the slide 50 moves in the direction of its stop, whereas the slide 47 remains at its stop. The ratio between the pressure medium quantities $Q_2$ and $Q_1$ is thereby displaced in such a way that the rotational movement of the scoop 14 clockwise predominates over the rotational movement of the extension arm 12 counterclockwise, and the scoop 14 is emptied. In this second range, the relation $Q_2=K_Q \times Q_1$ is no longer fulfilled. This is not even required, however, since, in this range, the scoop 14 is to be emptied in a controlled manner during the raising of the extension arm.

Figure 5:
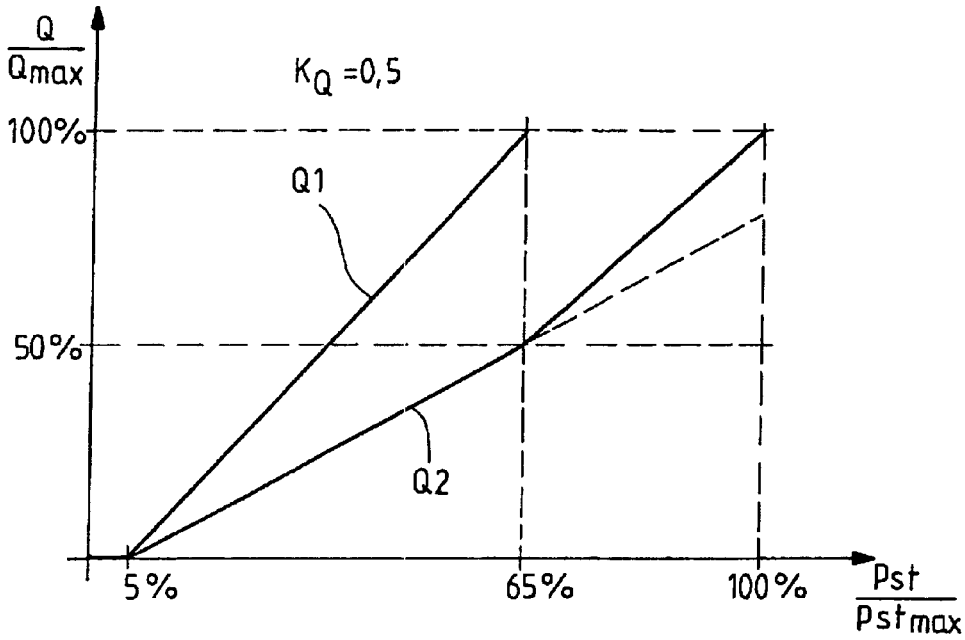
FIG. 5 shows the relation between the control pressures supplied to the valves and the pressure medium quantities supplied to the cylinders in the form of a graph.

FIG. 5 shows the relation between the control pressure $p_{st}$ and the pressure medium quantities $Q_1$ and $Q_2$ supplied to the cylinders 18 and 22 in the form of a graph. in abbreviated form by $p_{st}$, since the control pressure $p_{st2A}$ supplied to the valve 42 is equal to the control pressure $p_{st1A}$. The factor $K_Q$, in the graph, has a value of 0.5 for the range of 5% to 65% of $p_{stmax}$. The range of 0% to 5% of $p_{stmax}$ corresponds to a positive overlap of the valves 41 and 42, in that pressure medium is not yet flowing to the cylinders 18 and 22.

Figure 6:
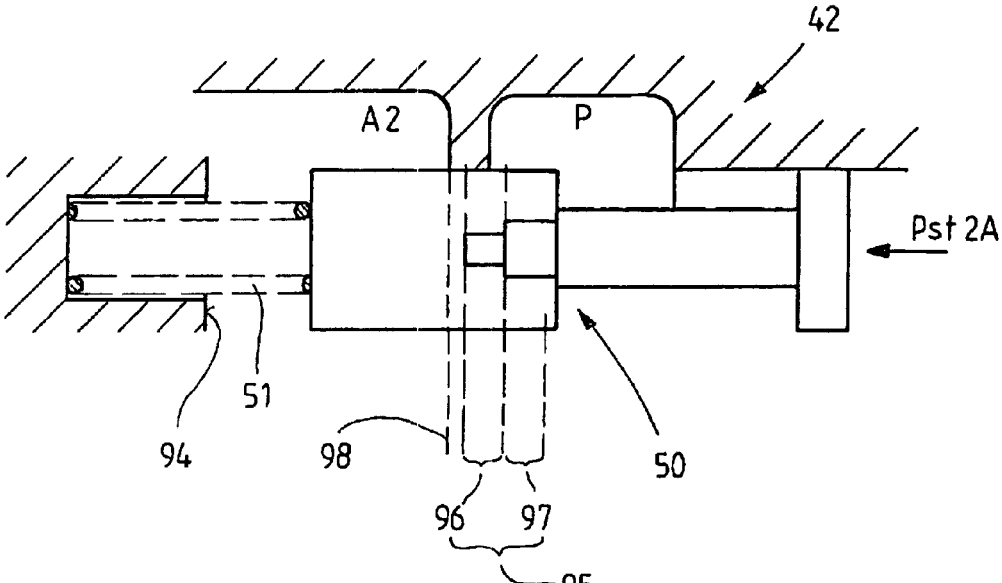
FIG. 6 shows a diagrammatic illustration of an embodiment of the slide of the valve actuating the scoop.

FIG. 6 shows a diagrammatic illustration of an embodiment of the slide 50 of the valve 42 actuating the scoop 14. 94 designates the stop, against which the slide 50 bears when the control pressure $p_{st2A}$ acting upon the slide 50 is equal to $p_{st1Amax}$. In FIG. 6, the slide 50 is illustrated in the position which it assumes when it is acted upon by no control pressure. The slide 50 is provided with a notch 95 which has two regions 96 and 97. Together with a control edge 98, when the control pressure $p_{st2A}$ acts upon the slide 50, the notch 95 results in a passage cross section $A_{A2}$ from the connection P to the connection A, said passage cross section, in the first region 96, being in the ratio, predetermined by the factor $K_Q$, to the corresponding passage cross section $A_{A1}$ of the valve 41. In the second region 97, the relation to the passage cross section $A_{A2}$ of the valve 41 is selected such that, as described above, an emptying of the scoop 14 during the raising of the extension arm 12 is possible.

Figure 7:
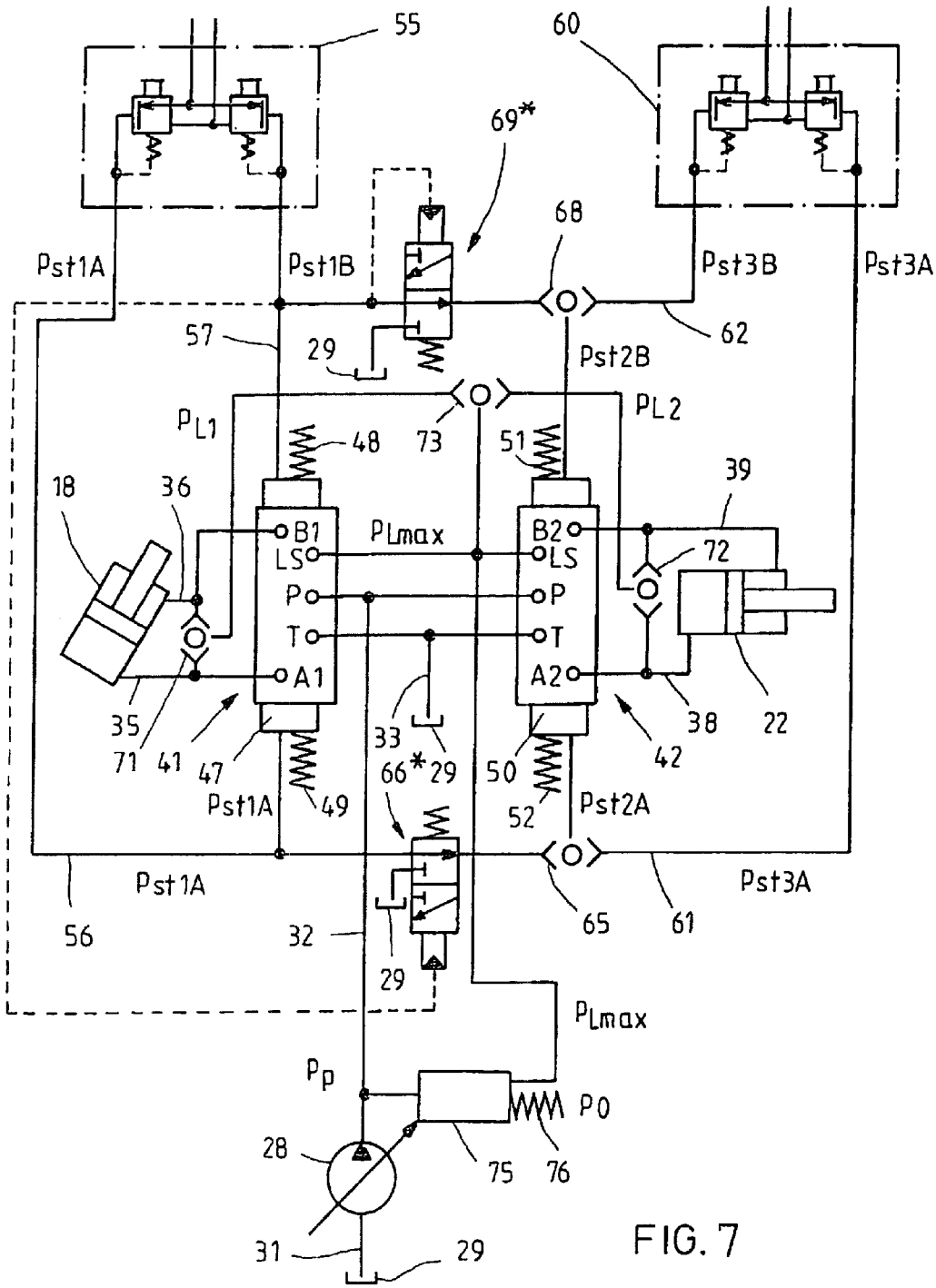
FIG. 7 shows a further embodiment of the control device illustrated in FIG. 1.

FIG. 7 shows an illustration, corresponding to FIG. 2, of a further embodiment of the control device 27 illustrated in FIG. 1. Instead of the electrically controlled switching valves 66 and 69 illustrated in FIG. 2, hydraulically controlled switching valves 66* and 69* are provided in FIG. 7. The switching valves 66* and 69* are controlled by the control pressure $p_{st1B}$ for the rotational movement of the extension arm 12 in the lowering direction in such a way that, up to an adjustable threshold value $p_{sts}$, they assume the switching position illustrated in FIG. 7. If the control pressure $p_{st1B}$ overshoots the threshold value $p_{sts}$, the switching valves 66* and 69* assume the other switching position, in which one inlet of the shuttle valve 65 or 68 is connected to the tank 29. This means that, for example, when the control pressure $p_{st1B}$ is higher than the threshold value $p_{sts}$, the control pressure $p_{st2A}$ or $p_{st2B}$ supplied to the valve 42 is equal to the pressure $p_{st3A}$ or $p_{st3B}$ of the pilot control apparatus 60, since this pressure, insofar as it is not equal to the tank pressure, is always higher than the latter. The switching valves 66* and 69* make it possible to use a valve 42 with a slide 47 which possesses a fourth position, also designated as a "floating position", for the lowering of the extension arm 12. In the floating position of the slide 47, the extension arm 12 descends at a speed dependent on the load. Since, in this position of the slide 47, there is no control of the descending speed by means of the valve 41, the volume flow apportionment described above in connection with FIGS. 1 to 3 can no longer operate accurately. In order, nevertheless, to prevent an uncontrolled rotational movement of the scoop 14, the switching valves 66* and 69* are switched into the switching position in which the rotational movement of the scoop 14 is controlled solely by the control pressure $p_{st3A}$ or $p_{st3B}$ Of the pilot control apparatus 60. In order to activate the floating position, the control pressure $p_{st1B}$ is increased to a value which is higher than the threshold value $p_{sts}$ which, in turn, is higher than the value corresponding to the maximum descending speed. This control pressure has the effect, on the one hand, that the slide 47 of the valve 41 is activated in such a way that it assumes the floating position, and, on the other hand, that the position of the slide 50 of the valve 42 is not influenced either by the control pressure $p_{st1B}$ or by the control pressure $p_{st1A}$ If the pilot control apparatus 55 is constructed in such a way that the control pressure $p_{st1A}$ is equal to the tank pressure at least when the control pressure $p_{st1B}$ is higher than the threshold value $p_{sts}$, the valve 66* may be dispensed with. For, in this case, it is ensured, even without the valve 66*, that the pressure $p_{st1A}$ is lower than the pressure $p_{st3A}$ or is at most equal to the latter. It is thus possible to use an electrically controlled valve 66 (as illustrated in FIG. 2) instead of the hydraulically controlled valve 66*. This embodiment makes it possible, at will, to make the volume flow apportionment according to the invention ineffective during the raising of the extension arm 12.

The invention claimed is:

1. A control device for a work appliance in which a shovel is held on an extension arm, in particular for a wheeled loader, comprising:

two hydraulic cylinders, of which the first actuates the extension arm and the second actuates the shovel;

a pump supplying the cylinders with pressure medium from a tank;

two valves, of which the first valve controls the supply of pressure medium from the pump to the first cylinder and the second valve controls the supply of pressure medium from the pump to the second cylinder, each valve being provided with a spool having a surface acted upon by an adjustable control pressure counter to the force of a spring and being provided with a notch which runs in its longitudinal direction and determines the size of the passage cross section of the valve and which is formed in such a way that the respective passage cross section of the valve is determined by the position of the spool;

two pressure compensators of which one is arranged downstream of the passage cross section of the one valve and the other downstream of the passage cross section of the other valve and which are acted upon in the closing direction by the highest load pressure and in the opening direction by the pressure downstream of the assigned passage cross section, whereby the valves can be activated in such a way that the ratio of the pressure medium quantities supplied to the two cylinders is held at a constant value independently of the size of the control pressure supplied to the first valve;

whereby a desired motional relationship between those parts of the equipment that are moved by the two hydraulic cylinders is maintained even in the event of an undersaturation condition.

2. A control device according to claim 1, wherein the passage cross section of the two valves changes linearly with the control pressure supplied to them.

3. A control device according to claim 1, wherein the surface of the spool of the first valve which is acted upon by the control pressure is equal to that surface of the spool of the second valve which is acted upon by the control pressure.

4. A control device according to claim 2, wherein the surface of the spool of the first valve which is acted upon by the control pressure is equal to that surface of the spool of the second valve which is acted upon by the control pressure.

5. control device according to claim 1, wherein the inlet of the second valve for the control pressure is preceded by a valve arrangement, via which said valve can be supplied with the control pressure for the rotational movement of the extension arm or with the control pressure for the rotational movement of the shovel.

6. A control device according to claim 5, wherein the valve arrangement is constructed as a shuttle valve, one inlet of which can be supplied with the control pressure for the rotational movement of the extension arm and the other inlet of which is supplied with the control pressure for the rotational movement of the shovel.

7. A control device according to claim 6, wherein the control pressure line leading to the first inlet of the shuttle valve, a switching valve is arranged, which, in one position, interrupts the supply of the control pressure for the rotational movement of the extension arm to the inlet for the control pressure of the second valve and at the same time supplies the first inlet of the shuttle valve with a pressure (tank pressure) which is lower than the respective control pressure for the rotational movement of the shovel or is equal to said control pressure.

8. A control device according to claim 5, wherein the valve arrangement interrupts the supply of the control pressure for the rotational movement of the extension arm in the lowering direction to the inlet for the control pressure of the second valve when this pressure ($_{Pst1B}$) overshoots an adjustable value.

9. A control device according to claim 8, wherein the switching valve interrupts the supply of the control pressure for the rotational movement of the extension arm in the raising direction to the first inlet of the assigned shuttle valve when the pressure for the rotational movement of the extension arm in the lowering direction overshoots an adjustable value.

10. A control device according to claim 1, wherein the notch of the spool of the second valve is formed in such a way that, when the spoor of the second valve is acted upon by a control pressure which is higher than the control pressure required for the maximum pressure medium quantity for the first valve, the passage cross section of the second valve increases with a rise in control pressure to a greater extent than in the range below the control pressure required for the maximum pressure medium quantity for the first valve.

11. A control device according to claim 1, wherein the spring constant of the spring acting on the first spool is equal to the spring constant of the spring acting on the second spool.

12. A control device according to claim 1, wherein a counterholding valve controlled by the inflow pressure is arranged in a line leading from a cylinder acted upon by a pulling load to the tank.

* * * * *